United States Patent [19]

Schwartz et al.

[11] 4,275,475

[45] Jun. 30, 1981

[54] PIPELINE PIG

[76] Inventors: Robert E. Schwartz, 4227 E. 52 Pl., Tulsa, Okla. 74145; Laurence M. Neff, 10031 E. 52nd St., Tulsa, Okla. 74145; Gary N. Utter, 5603 S. 77 E. Ave., Tulsa, Okla. 74145

[21] Appl. No.: 90,628

[22] Filed: Nov. 2, 1979

[51] Int. Cl.[3] ..... B08B 9/04

[52] U.S. Cl. ..... 15/104.06 R; 137/268

[58] Field of Search ..... 15/104.06 R, 104.06 A, 15/3.5, 3.51; 137/268

[56] References Cited

U.S. PATENT DOCUMENTS

| | | | |
|---|---|---|---|
| 2,392,144 | 1/1946 | Hall | 15/104.06 R |
| 4,083,074 | 4/1978 | Curtis | 15/104.06 R |

FOREIGN PATENT DOCUMENTS

| | | | |
|---|---|---|---|
| 2141349 | 3/1973 | Fed. Rep. of Germany | 15/104.06 R |
| 802406 | 10/1958 | United Kingdom | 15/104.06 R |
| 859032 | 1/1961 | United Kingdom | 15/104.06 R |

*Primary Examiner*—Edward L. Roberts

*Attorney, Agent, or Firm*—Head & Johnson

[57] ABSTRACT

A pipeline pig having a shaft of flexible plastic with an enlarged head portion, a plurality of dish members of flexible plastic, a plurality of flexible spacers, the dish member and spacers each having an axial opening therethrough receiving the shaft, each spacer having an integral cup portion at one end, two spacers being received on the shaft in back-to-back relationship between adjacent dish members, and a retainer member on the shaft adjacent the rearward end holding the dish members and spacers in engagement with each other, and thereby holding the dish members in spaced apart relationship, the dish members being of an outside diameter configured to closely correspond with the inside diameter of the pipeline in which the pig is used.

7 Claims, 6 Drawing Figures

PIPELINE PIG

BACKGROUND OF THE INVENTION

1. Field of the Invention

This invention relates to pipeline scrapers, usually referred to as pipeline pigs of the type which are placed in a pipeline and moved along by the fluid flow. Pipeline pigs are used for a number of purposes including scraping the interior of a line to remove rust and encrustation, separating one fluid component from another, and when used in pipelines for conveying gas, forcing the removal of water and other liquids which have condensed in the line and settled in low areas.

The present invention is directed towards an improved flexible pipeline pig which has advantages over previously known constructions. The primary advantages are that the pig easily bends around corners or imperfections in a pipeline and is formed of plastic material having the benefits of economy, long life, and freedom from reaction with the fluids found in most pipelines.

2. Description of Prior Art

The use of pipeline pigs is well known in the industry. Pigs have been designed for various applications and uses. Some pipeline pigs include wire brushes for scouring the interior of the lines through which they pass. Others include arrangements wherein portions of the pipeline pig are hinged to each other to allow flexibility. While existing types of pipeline pigs work satisfactorily, a disadvantage in existing designs is that they are either formed of a fixed central shaft and therefore, are inflexible, or, if made to be flexible, include components which are hinged together and thereby substantially increasing the costs or of one piece construction with no re-usable components therefore losing the whole pig when damaged.

An object of the present invention is to provide a pipeline pig which has the advantage of increased flexiblity while at the same time eliminating the requirement of hinged connections between portions of the pig or loss of the entire pig when damaged.

More particularly, an object of this invention is to provide an improved flexible pipeline pig formed substantially all of plastic components which are quickly and easily assembled on a flexible plastic shaft and which thereby achieves economy of manufacture and improved results of use.

These general objects as well as other and more specific objects of the invention will be fulfilled in the following description and claims taken in conjunction with the attached drawings.

SUMMARY OF THE INVENTION

The invention provides an improved pipeline pig. The pig is formed of a shaft of flexible plastic material having a forward end and a rearward end. The forward end of the shaft has an enlarged head portion. Positioned on the shaft is a plurality of dish members, each formed of flexible plastic. Each dish member has an integral forward radial portion having an opening therethrough receiving the shaft. Integrally connected around the circumferential edge of the radial portion is a rearwardly extending outer portion. The total dish member is in the general shape of a dish having an opening therethrough so that it is axially received on the shaft. A plurality of flexible plastic spacers is used, each of the spacers having an axial opening therethrough receiving the shaft. Each spacer has an integral cup portion at one end of an outside diameter equal to or less than the diameter of the radial portion of the dish members. Two spacers are received on the shaft in back-to-back relationship between adjacent dish members, thereby the cup portion of the forward spacer of each pair contacts the rearward face of an adjacent dish member, and the cup portion of the rearward spacer of each pair contacts the forward face of the next adjacent rearwardly positioned dish member. A retainer is received on the shaft adjacent the rearward end thereof to lock the dish members and spacers in contiguous relationship. The assembled pig then provides a plurality of spaced apart dish members flexibly supported to each other by the flexible shaft on which the members are assembled. Flexibility of the assembled pig is enhanced by the cup portions of the spacers. The assembled pipeline pig is of substantially all plastic material and thereby can be manufactured with a high degree of economy while nevertheless providing a pipeline pig having desired flexibility for use in pipelines.

DESCRIPTION OF THE PREFERRED EMBODIMENTS

Figure 1:
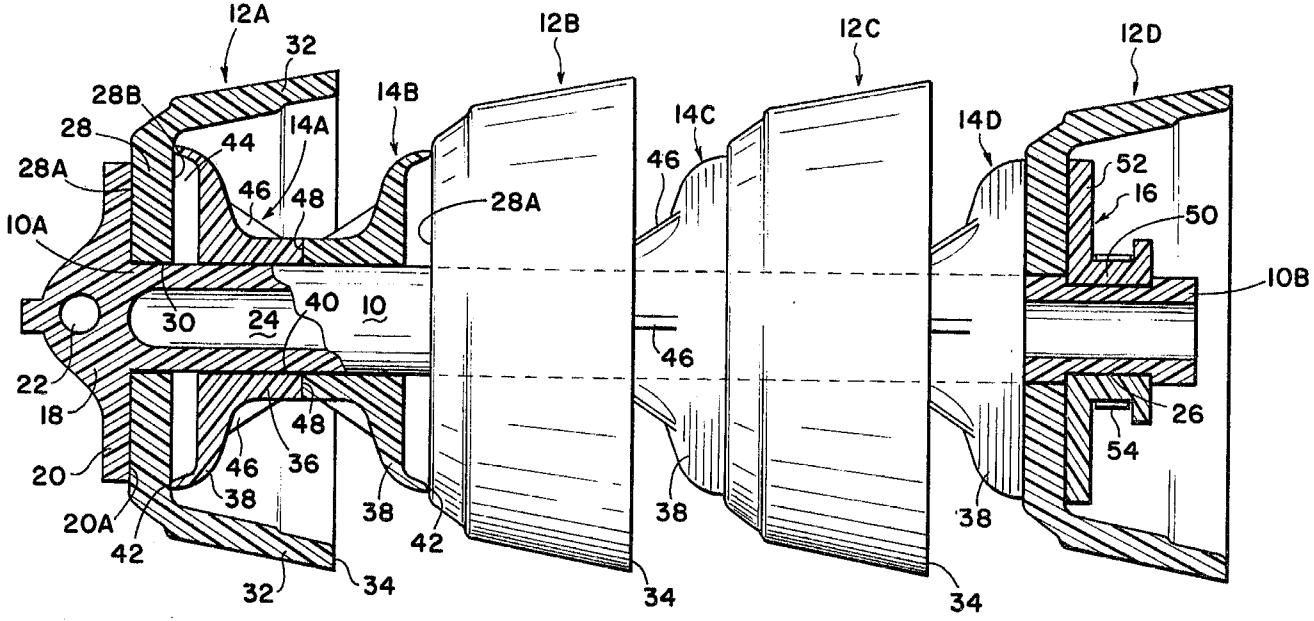
FIGS. 1 is an elevational view, shown partly in cross-section, of a preferred embodiment of the pipeline pig of the present invention.

Referring to FIG. 1, the preferred embodiment of the invention is illustrated in a side elevational view and partially in cross-section. The pipeline pig is formed of four primary pieces, that is, a shaft of flexible plastic material 10; a plurality of dish members, four being shown, and identified generally by the numerals 12A through 12D; a plurality of spacers, there being two between adjacent dish members 12, the spacers being identified generally by the numerals 14A through 14D; and a retainer member 16. Each of the basic elements of the invention will be described now in detail.

The shaft 10 includes a forward end 10A and a rearward end 10B. The forward end 10A has an integral enlarged head portion 18. The head portion 18 includes an enlarged diameter flange portion 20 having a planar rearward surface 20A. The head portion 18 also includes, as illustrated, an opening 22 therethrough.

The shaft 10 is of a uniform diameter rearwardly of the head portion 18 and may be as long as necessary according to the number of dish members which is to be employed in the make-up of the pig. The shaft 10 is of diameter sufficient to give strength required for the pig but no greater than necessary so as to provide maximum flexibility. To increase the flexibility of shaft 10 it may have a hollow core 24 as illustrated. Near the rearward end 10B of the shaft is a reduced external diameter groove 26 which receives the retainer 16 in a manner to be described subsequently.

Each of the dish members 12 is formed of integral flexible plastic material. Each dish member includes a radial inner portion 28 having a forward face 28A and a rearward face 28B. The inner portion 28 has an opening 30 which receives shaft 10.

Each dish member includes an integral rearwardly extending outer portion 22 having a maximum outer diameter at the rearward end 34 of the dish member substantially equal to the internal diameter of the pipeline in which the pig is to be used. The thickness of the wall of the rearward extending portion 32 preferably tapers to a reduced thickness at the dish member rearward end 34 so that increased flexibility is provided. This increased flexibility of the dish members enables them to be deformed in response to changes in the internal diameter of the pipe, while nevertheless, especially when there is fluid pressure rearwardly of the pig, to expand outwardly to engage the pipe wall.

Each of the spacer members 14 includes an integral tubular portion 36 and an integral cup-shaped portion 38. The spacer members each have an opening 40 therethrough receiving shaft 10. In the illustrated and preferred arrangement of the spacers 14, the cup-shaped portion 38 has a forwardly extending circumferential lip 42 having an outside diameter equal to or less than the diameter of the dish member radial portion 28. The forwardly extending lip portion 42 engages the disc portion 28 of adjacent dish members and provides a space 44 between the spacer cup-shaped portion 38 and a dish member. The importance of the relationship of this space 44 and the function of the pipeline pig will be described subsequently.

In order to improve the strength of dividers 14, integral ridges 46 do extend in radial planes spaced around the external periphery of the disc member between the integral tubular portion 36 and the integral cup-shaped portion 38.

The spacer members have a rearward end 48 at the end of the integral tubular portion 36. The spacer members are assembled in back-to-back relationship, that is, where the tubular ends 48 engage each other. This arrangement means that the lip portions 42 of each of the divider cup-shape portions engage the radial portion 38 of adjacent dish members.

Figure 2:
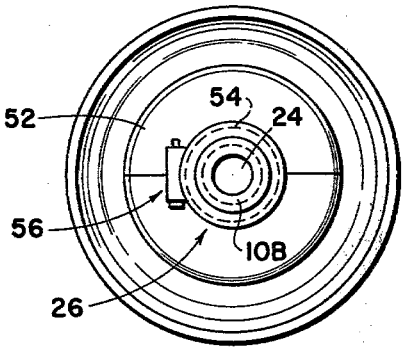
FIG. 2 is a rearward view of the pipeline pig of FIG. 1 showing the retainer member at the end of the shaft retaining the elements of the pig together.
Figure 3:
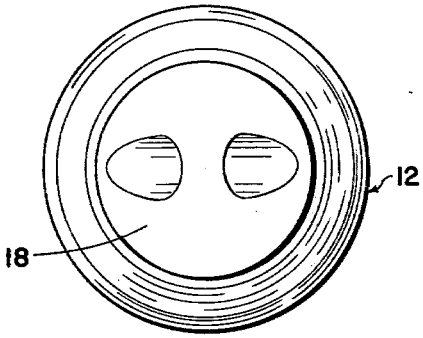
FIG. 3 is a front end view of the pipeline pig of FIG. 1 showing the integral head portion of the shaft and first dish member.

In order to retain the dish members and dividers in contiguous relationship, the retainer member 16 is employed. It includes an integral tubular portion 50 and an integral raidal portion 52. The tubular portion 50 is designed to fit in the groove 26 in the external surface of the shaft 10. The retainer 16 is preferably bifurcated, that is, formed of two identical portions which mate together and are held in position in groove 26 by means such as a metal band 54 which may be in the form of a typical hose clamp 56, best seen in FIG. 2.

The assembled pipeline pig has the advantages previously enumerated. It is formed substantially of plastic material which has the advantage of economy, durability, and freedom of reaction with most pipeline fluids, whether liquids or gases. The only non-plastic part of the pipeline pig illustrated in FIG. 1 is the metal band 54 and hose clamp 56 which hold the retainer portions together. The pig as described is extremely flexible even though lacking any hinged connections. The shaft 20 is of sufficiently small diameter to permit easy flexing. In addition, the cupped configuration of the spacers, particularly the arrangement wherein the forward lip portions 42 provide space 44 between the spacer and the adjacent dish members, provide a high degree of flexibility between these elements. Thus, while the dish members are structurally supported by the back-to-back spacers so that the outer edges of the rearwardly extending portions 32 of the dish members can engage the interior of the pipeline in which the pig is being used, nevertheless, flexing is provided when the pig needs to bend in passing around corners or past irregularities in a pipeline. The length of the pig is dependent solely on the length of shaft 10 since the dish members and dividers may be assembled repeatedly as necessary to achieve the desired length.

Figure 5:
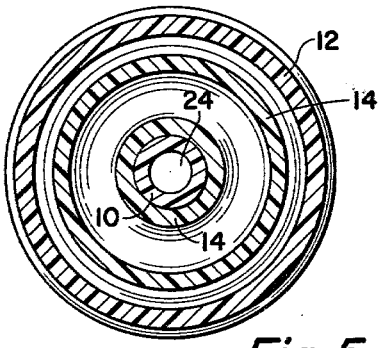
FIG. 5 is a cross-sectional view taken along the line 5—5 of FIG. 4.

FIG. 5 shows an alternate embodiment of the invention. This embodiment includes the use of spacers 58 as well as dividers 14 between adjacent dish members. Each spacer 58 includes an integral tubular portion 60 and an integral radial portion 62, both portions having an opening 64 therein receiving the shaft 10. Each spacer 58 engages a dish member forward face 28A and the rearward end 48 of the adjacent forward spacer 14.

In FIG. 5 the spacers 14 are of somewhat different configuration than in FIG. 1; however, they function in the same way, as each includes the lip portion 42 engaging the next adjacent dish member and providing opening 44 between the spacer and the dish member to allow the flexibility of the pipeline pig as previously discussed.

Figure 4:
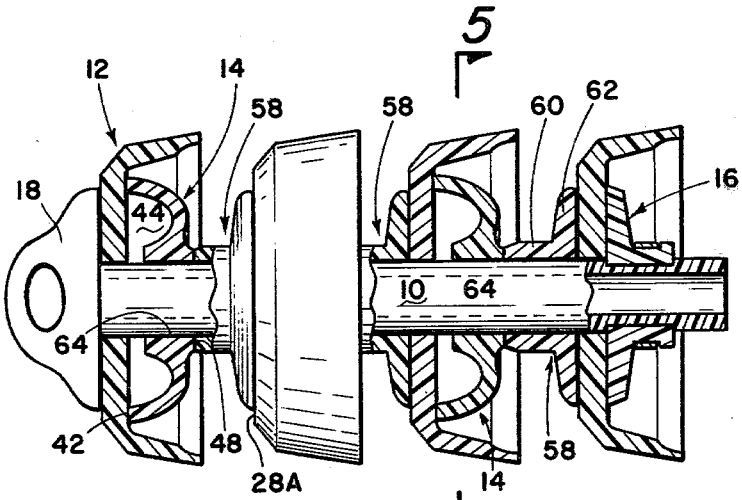
FIG. 4 is an elevational side view, shown partly in cross-section, of an alternate embodiment of the invention in which a spacer and a cup member is used between adjacent dish members.

The embodiment of FIG. 4 functions in the same way as that of FIG. 1. The arrangement of FIG. 1 is somewhat preferred, however, since it employs four molded elements, whereas the FIG. 4 arrangement employs five molded elements, that is, the shaft 10, the dish members 12, the spacers 14, the dividers 58, and the retainer 16.

Figure 6:
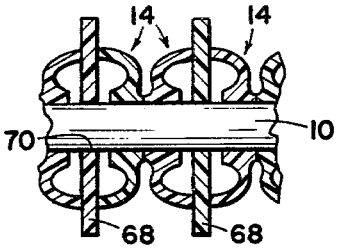
FIG. 6 is an elevational cross-sectional view of a middle portion of a pipeline pig showing another alternate embodiment wherein the dish members are replaced with disc members of the type wherein the pig is used primarily for scraping the interior of a pipeline.

FIG. 6 shows a cross-sectional view of an intermediate portion of the pipeline pig in an alternate arrangement. When the pig is to be used primarily for scraping purposes to dislodge rust or encrustation on the interior walls of the pipeline, the dish-shaped members may be replaced by flat discs 68. Each of the flat discs has an opening 70 therein receiving the shaft 10 and an outside diameter which proximates that of the pipeline in which the pig is to be used.

The invention described fulfills all of the objectives initially set forth. A pipeline pig is disclosed having the unique quality of being assembled for variable length out of only four molded components, all of which may be formed of plastic and, wherein when the pig is assembled, a highly flexible arrangement is provided without necessity for the employment of hinged construction and allow replacing of worn or damaged components.

While the invention has been described with a certain degree of particularity, it is manifest that many changes may be made in the details of construction and the arrangment of components without departing from the spirit and scope of this disclosure. It is understood that the invention is not limited to the embodiments set forth herein for purposes of exemplification, but is to be limited only by the scope of the attached claim or claims, including the full range of equivalency to which each element thereof is entitled.

What is claimed is:

1. A pipeline pig comprising:

a shaft of flexible plastic having a forward end and a rearward end and having an enlarged head portion at the forward end;

a plurality of dish members of flexible plastic each havng an axial opening therethrough, each dish member having a radial inner portion having a forward and rearward face and an integral rearwardly extending outer portion;

a plurality of flexible plastic spacers, each having an axial opening therethrough, each spacer having an integral cup portion at one end of an outside diameter less than the diameter of said radial inner portion of sid dish members, two spacers being received on said shaft in back-to-back relationship between adjacent dish members, the cup portion of the forward spacer of each pair contacting the rearward face of an adjacent dish member and the cup portion of the rearward spacer of each pair contacting the forward face of an adjacent rearward dish member;

and a retainer member received on said shaft adjacent said rearward end, said dish members and spacers being held in contiguous relationship.

2. A pipeline pig according to claim 1 wherein each said dish members rearwardly extending outer portion is of reduced thickness adjacent the periphery.

3. A pipeline pig accordng to claim 1 wherein said shaft rearwardly of said head portion is tubular.

4. A pipeline pig according to claim 1 wherein said shaft has a reduced diameter portion adjacent said rearward end receiving said retainer.

5. A pipeline pig according to claim 1 wherein each said spacer includes an integral tubular portion extending opposite said cup shaped portion, and including a plurality of equally spaced integral radially extending ridges between said tubular portion and cup shaped portion.

6. A pipeline pig comprising:

a shaft of flexible plastic having a front end and a rearward end and an enlarged head portion to the forward end;

a plurality of dish members of flexible plastic each having an axial opening therethrough, each dish member having a radial inner portion having a forward and rearward face and an integral rearwardly extending outer portion;

a plurality of spacers of flexible plastic each having an axial opening therethrough, each spacer having an integral forward cup portion having a forwardly extending peripheral surface of diameter less than the diameter of said dish member radial inner portion;

a plurality of dividers of flexible plastic each having a tubular forward portion and an integral enlarged diameter radial rearward portion and having an axial opening therethrough, said dish members, said spacers and said dividers being assembled in repetitive sequence on said shaft, the cup portion of said spacers engaging the rearward face of said dish members inner portion and providing an enclosed space between each said spacer and each said dish member; and a retainer member received on said shaft adjacent said rearward end holding said dish members, said spacers and said dividers in contiguous relationship.

7. A pipeline pig comprising:

a shaft of flexible plastic having a forward and a rearward end having an enlarged head portion at the forward end;

a plurality of discs of flexible plastic having a radial opening therethrough;

a plurality of spacers of flexible plastic each having an axial opening therethrough, each spacer having an integral cup portion at one end of outside diameter less than the diameter of said discs, two spacers being received on said shaft in back-to-back relationship between adjacent discs, the outer peripheral surface of each cup portion of each spacer engaging a disc and providing a confined area between each spacer and disc; and a retainer member received on said shaft adjacent said rearward end, said discs and spacers being held in contiguous relationship.

* * * * *